United States Patent [19]

Roden, Jr.

[11] Patent Number: 4,667,992

[45] Date of Patent: May 26, 1987

[54] SECURITY BAR FOR INWARDLY SWINGING DOORS

[76] Inventor: Ralph V. Roden, Jr., P.O. Box 8276, Ft. Worth, Tex. 76124

[21] Appl. No.: 819,589

[22] Filed: Jan. 17, 1986

[51] Int. Cl.[4] ..... E05C 17/12

[52] U.S. Cl. ..... 292/259 R

[58] Field of Search ..... 292/259, 260, 302, 264, 292/DIG. 60

[56] References Cited

U.S. PATENT DOCUMENTS

| | | | |
|---|---|---|---|
| 1,961,383 | 6/1934 | Nye et al. | 292/302 |
| 3,815,389 | 6/1974 | Richards, Sr. | 292/259 R X |
| 4,330,147 | 5/1982 | Nolen | 292/259 R |
| 4,453,751 | 6/1984 | Hamilton | 292/340 |

*Primary Examiner*—Richard E. Moore

*Attorney, Agent, or Firm*—James E. Bradley

[57] ABSTRACT

A security bar for a door is mounted on retainers on each side of the frame of the door. Each retainer has a base surface, the inclination of which can be adjusted relative to the head of the retainer to accommodate door trim that inclines relative to the plane of the frame. The bar has slots on each end for engaging the retainer. One of the slots is parallel with the axis of the bar for sliding over one of the retainers. The other slot is perpendicular to the axis of the bar for sliding downwardly onto the other retainer. A sliding locking plate locks the bar to the retainer once in position. The retainers can be installed on wooden door frames, or on metal door frames. On metal door frames, a placement hole is drilled on the inside of the door frame to insert a barrel nut. A placement tool holds the barrel nut while tightening to a screw extending through the retainer.

8 Claims, 9 Drawing Figures

SECURITY BAR FOR INWARDLY SWINGING DOORS

BACKGROUND OF THE INVENTION

1. Field of the Invention

This invention relates in general to security bars for placement across a door to prevent opening, and in particular to a security bar for an inward swinging door, having improved retaining means.

2. Description of the Prior Art

Security bars placed across a door frame to prevent its opening are most commonly used in commercial buildings, particularly at the exit. Normally, there will be upwardly facing channels or brackets mounted to the frame on opposite sides of the door for receiving a bar.

Security bars of this nature are not commonly used in residential homes. The typical brackets such as used in commercial buildings do not have an attractive appearance and are rather large. Also, often, the inward facing trim or door jamb of the frame is not parallel with the frame of the plane. This makes it difficult to mount a bracket for a bar.

An attractive, easily installed security bar for a residence is needed because many door jambs are not sufficiently strong to withstand an impact from an intruder. Such an impact could shatter the retainer for a dead bolt lock. Also, the small planes of French doors can be broken to provide access. Moreover, it may be that the key to the dead bolt lock has been duplicated by others.

Improvements are also needed in the case of commercial building security. Often, the door frame will be of a metal channel member which is hollow. There will be no wooden stud therein in which to secure a long screw for a bracket. There is no means to position a nut to tighten a bolt against. Normally, the retaining brackets are secured by metal screws which are screwed into holes drilled in the metal door frame. Metal screws are not strong enough to withstand severe impacts from the exterior.

SUMMARY OF THE INVENTION

In this invention, a bar retainer is provided that has the ability to be mounted to door trim that is not parallel with the plane of the frame. The bar retainer has a base surface that mounts to the inward facing surface of the door trim. The retainer has a neck member that protrudes from the base for receiving the bar. The neck member and the base surface can be adjusted relative to each other for varying the inclination. The adjustment is handled by the mating surfaces of the base and the neck member, which incline relative to the central axis of each member. Rotating one of the members relative to the other varies the inclination of the base relative to the central axis.

The bar has slots for reception over the neck members. The slot on one end is an elongated slot parallel with the axis of the bar. The slot on the other end is perpendicular to the bar axis. The neck member has a head that is larger than either of the slots, but each slot has an entrance to allow the head to be inserted within, where it is retained by the housing of the bar. A sliding locking plate can be moved to a locked position to close the entrance of the perpendicular slot to prevent the bar from being removed.

For hollow metal frames, a screw is secured to a locking member that is inserted into the hollow frame. The locking member is a cylindrical member having a threaded mounting hole for receiving the screw. The locking member is inserted through a hole drilled in the inside surface of the door frame. It is inserted by means of a placement tool, which includes a threaded shaft secured within a placement hole drilled in the locking member.

DESCRIPTION OF THE PREFERRED EMBODIMENT

Figure 1:
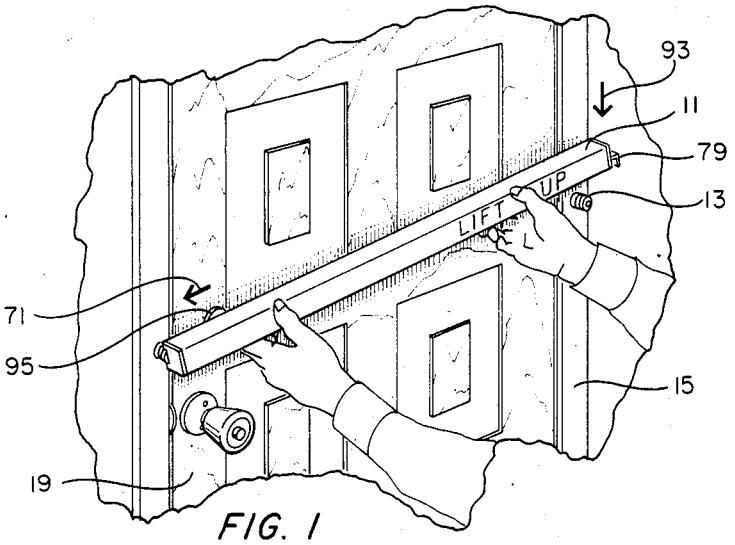
FIG. 1 is a perspective view of a security bar apparatus constructed in accordance with this invention, showing the bar in the process of being placed on the retainers which are mounted to a wooden door frame.
Figure 2:
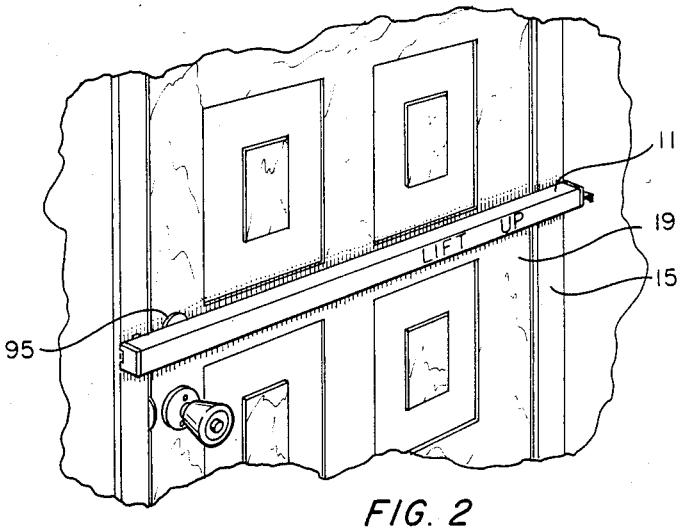
FIG. 2 is a view of the security bar apparatus of FIG. 1, showing it in position on the door frame.
Figure 3:
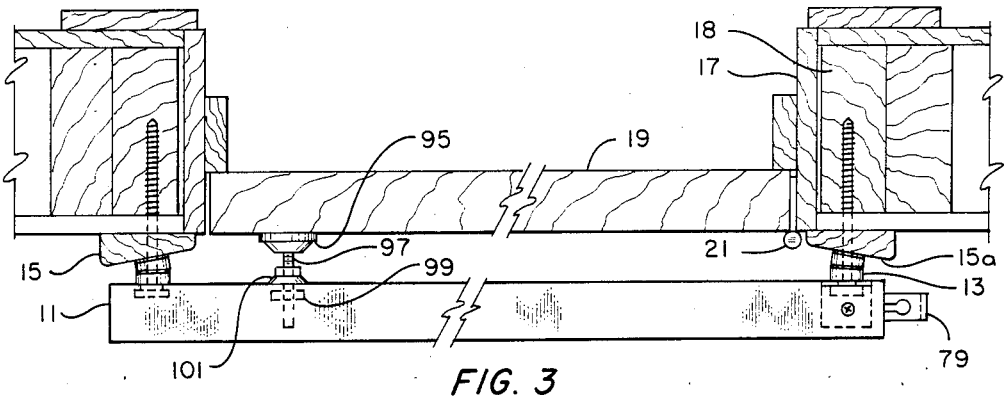
FIG. 3 is a top, partially sectioned view, showing the security bar apparatus of FIG. 1.

Referring to FIG. 1, a security bar 11 is shown being placed on retainers 13 mounted to the door jamb or trim 15. As shown in FIG. 3, the door trim 15 in this embodiment is of a type that has an inwardly facing surface 15*a* that is not parallel with the plane of the door frame 17 of which it is a part. Rather, the surfaces 15*a* incline inwardly toward each other. The door frame 17 in this embodiment is of a typical type in a residential home, having wooden studs 18. A door 19 is mounted on hinges 21 on one side. Door 19 opens inwardly, which is the direction toward the bar 11, as shown in FIG. 3.

Figure 7:
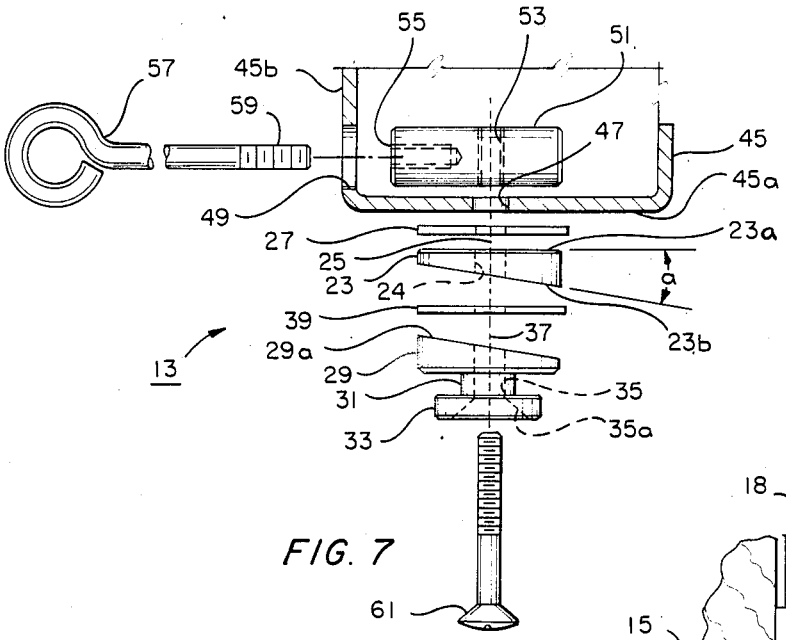
FIG. 7 is the exploded view showing one of the retainers for the security bar of FIG. 1, and showing it being installed on a metal frame.
Figure 9:
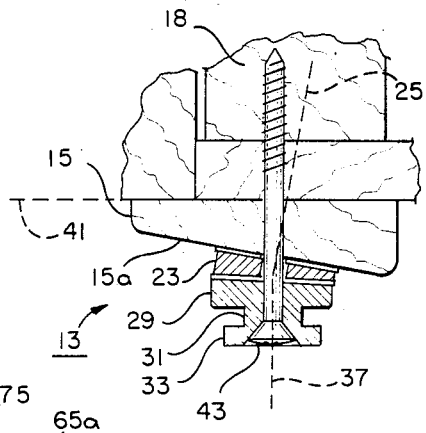
FIG. 9 is a sectional enlarged view of one of the retainers for the security bar of FIG. 1, shown installed on a wooden door frame.

The retainer 13 is shown in more detail in FIG. 9. FIG. 7 also shows the same retainer 13 installed on a metal door frame. The retainer 13 includes a base 23, which is a circular metal washer of special configuration. Base 23 has a base surface 23*a* which engages the inward facing surface 15*a* of the door trim 15. An inclined surface 23*b* is located on the opposite side of the base surface 23*a*. A central axial hole 24 extends through the base 23 along a central axis 25. The base surface 23*a* is perpendicular to the axis 25. The inclined surface 23*b* is located in a plane transverse to the axis 25, preferably at an angle a (FIG. 7) of about 10 degrees. A flat rubber washer or gasket 27, locates between the base surface 23*a* and the door trim surface 15*a*.

Retainer 13 also includes a neck member 29. Neck member 29 has an inclined surface 29*a* that cooperates with the inclined surface 23*b* of the base 23. Neck member 29 includes a reduced diameter cylindrical neck 31 that is smaller in diameter than inclined surface 29*a*. There is also a head 33 located on the extreme end that is cylindrical and larger in diameter than the neck 31. A hole 35 extends completely through the neck member 29. Hole 35 has a conical entrance 35*a*. Hole 35 is located on a central axis 37 that extends through the neck member 29. A rubber gasket or washer 39 is adapted to be placed between the neck member 29 and the base 23.

The inclined surface 29*a* of the neck member 29 matches the inclined surface 23*b* of base 23. It is located in a plane and inclines relative to axis 37 at the same angle a. Head 33 is perpendicular to axis 37. The neck member 29 and the base 23 can be rotated to various positions to match the inclination of the base surface 23*a*. As shown in FIG. 9, the base 23 and neck member 29 can be rotated so that the base surface 23*a* will be at a maximum angle relative to the head 33 that is two times the angle a. This allows the head 33 to remain parallel to the plane 41 of the frame 17, even though the trim surface 15*a* inclines at the same angle two times a.

The axis 25 of the base 23 remains perpendicular to the trim surface 15*a*, and it will intersect the axis 37 in the position shown in FIG. 9. Rotating the base 23 relative to the neck member 29 changes the inclination of the base surface 23*a* relative to the plane 41 of frame 17 from the maximum angle two times a (FIG. 9) to a point where it is parallel with the plane of the frame as shown in FIG. 7. In this manner, the head 33 can be positioned parallel with the plane 41 for door trim 15 of various inclinations.

For the embodiment in FIG. 1 and 9, the retainer 13 is fastened to the door frame 17 by means of a long wood screw 43 which extends into the stud 18. The holes 24 and 35 in the base 23 and neck member 29 are sufficiently larger in diameter than the screw 43 so as to allow the screw 43 to pass through, even through the hole 24 may be inclined relative to the screw 43, as shown in FIG. 9.

In the embodiment of FIG. 7, the metal door frame 45 normally would not be mounted to any type of wooden stud, and it is a hollow channel shaped member. Frame 45 is typically used in commercial building construction. The door frame 45 has a mounting surface 45*a* which normally is parallel with the plane of the frame 45, although it could be bent slightly due to faulty installation. If parallel, as shown in FIG. 7, the base 23 and neck member 29 are rotated relative to each other so that the head 33 and the base surface 23*a* are parallel with each other and with the plane of the frame 45.

Metal door frame 45 also has an inside surface 45*b* that is perpendicular to the mounting surface 45*a*. The retainer 13 is installed on the metal door frame 45 by drilling a hole 47 through the mounting surface 45*a*. A placement hole 49 is drilled through the inside surface 45*b* perpendicular to the mounting hole 47.

A special configured barrel nut 51 is used to secure the retainer 13 to the metal door frame 15. Barrel nut 51 is a cylindrical member having a threaded retaining hole 53 drilled through its transverse to its longitudinal axis. A placement hole 55 is drilled into one end to a selected depth. Placement hole 55 is perpendicular to the retaining hole 53. A placement tool 57 is used to insert the barrel nut 51 through the hole 49. The placement tool 57 includes a threaded shaft 59 that threads into the placement hole 55.

Figure 6:
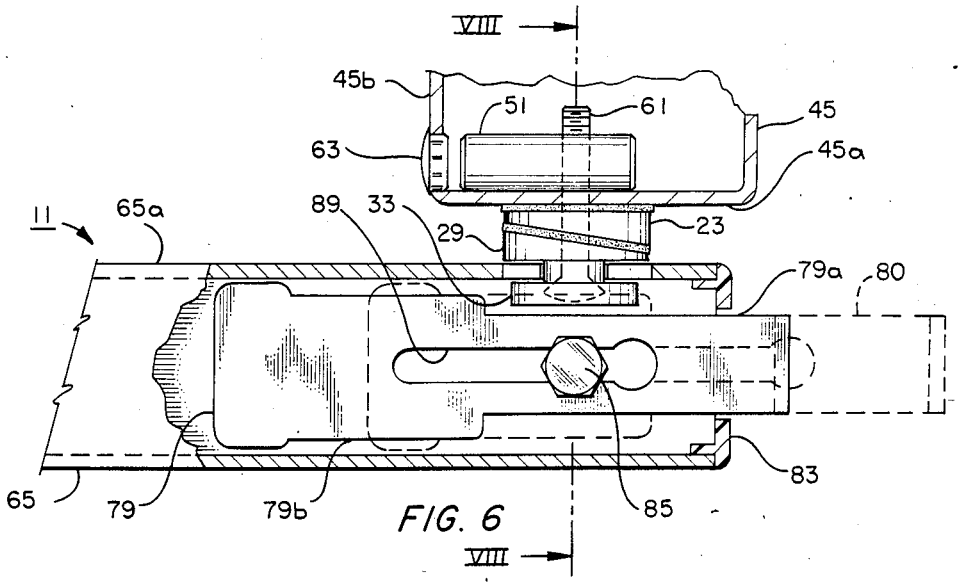
FIG. 6 is a sectional view of the security bar of FIG. 1, taken along the line VI—VI of FIG. 5 and showing the retainer installed on a metal door frame.

The installer secures the placement tool 57 to the barrel nut 51 and inserts it through hole 49 until the retaining hole 53 is in axial alignment with the mounting hole 47. A bolt 61 is inserted through the base 23 and neck member 29 and threaded into the retaining hole 53. The placement tool 57 holds the barrel nut 51 while the screw 61 tightened, tightly drawing the retainer 13 to the frame 45. Once tightened, the placement tool 57 is unscrewed and a rubber plug 63 (FIG. 6) is inserted into the placement hole 49 to cover the hole.

The barrel nut 51 serves as a locking member to lock the fastener or bolt 61, and thus the retainer 13 in place. The threaded shaft 59 of the placement tool 57, and the placement hole 55 serve as holding means for holding the barrel nut 51 in place while the retainer 13 is secured.

Figure 4:
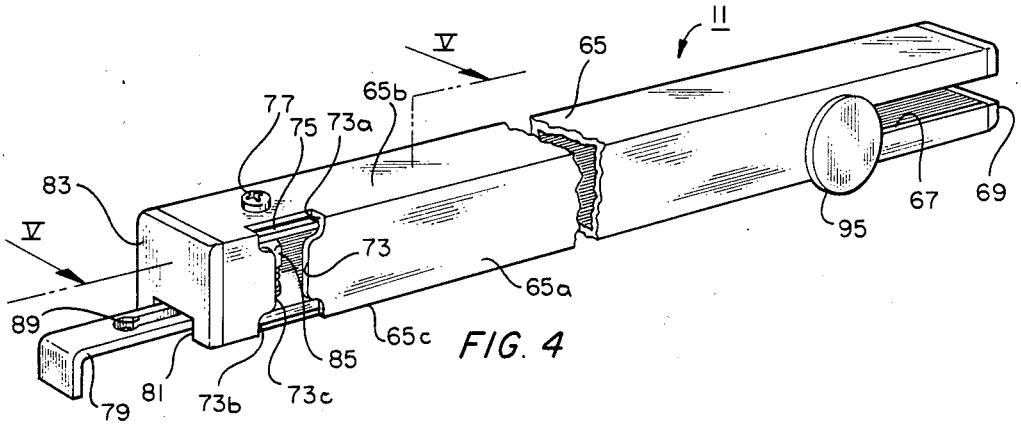
FIG. 4 is a view of the door facing side of the security bar of FIG. 1.

Referring to FIG. 4, the bar 11 includes a rectangular tubular housing 65. Housing 65 has a door facing side 65*a*, a top 65*b* and a bottom 65*c*. A slot 67 is cut into one end of the door facing side 65*a*. Slot 67 is elongated and extends from an end plate 69 parallel to the axis of the housing 65. As shown by the arrow 71 in FIG. 1, the slot 67 allows the bar 11 to slide laterally around the neck 31 of the retainer 13 on the left hand side. The entry to the slot 67 located in plate 69 is sufficiently large to admit the head 33 to allow the bar to be moved in an axial direction relative to the neck 31. The width of the slot 67 is less than the diameter of the head 33 to retain the bar 11 on the left hand retainer 13 once the head 33 enters the inside of the housing 65.

Figure 5:
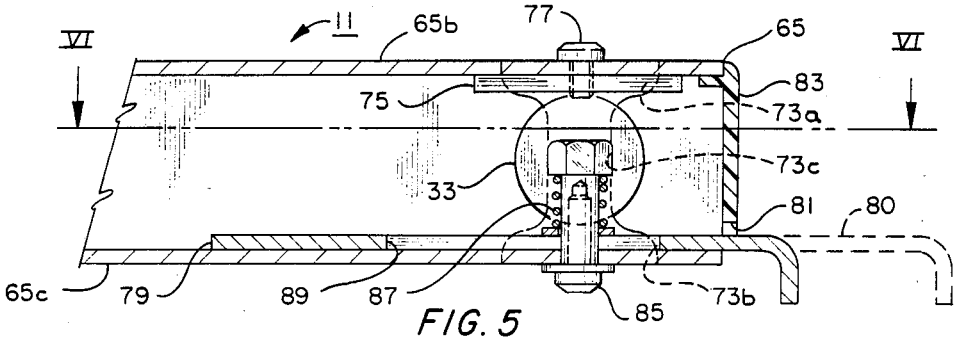
FIG. 5 is a partially section view of one end of the security bar of FIG. 1, taken along the line V—V of FIG. 4.

Another slot 73 is formed on the right hand side, as shown in FIGS. 4 and 5, but it extends perpendicular to the axis of housing 65. Slot 73 has a top opening 73*a* extending partially into the top 65*b* of the housing. Slot 73 also has a bottom opening 73*b* that extends partially into the bottom 65*c* of the housing. A reduced diameter section 73*c* is located in the door facing side 65*a* between the top and bottom opening 73*a* and 73*b*. The top and bottom openings 73*a* and 73*b* are large enough to admit the head 33 (FIG. 6) of the retainer 13. The reduced diameter section 73*c* closely receives the neck 31, but is smaller in width than the head 33 to retain the bar 11 on the retainer 13.

Figure 8:
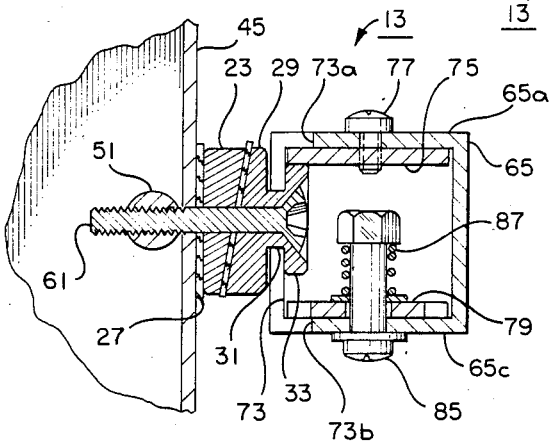
FIG. 8 is a sectional view of the security bar of FIG. 1, taken along the line VIII—VIII of FIG. 6.

As shown also in FIG. 8, a metal plate 75 is secured to a screw 77 to the inside surface of the top 65*b* of housing 65. Plate 75 blocks the top opening 73*a* to prevent the head 33 from passing through the top opening 73*a*.

A sliding locking plate 79 is used to secure the bar 11 on the right hand retainer 13. Locking plate 79 has a portion that is slidingly carried on the inside surface of the housing bottom 65*c*. Locking plate 79 has a reduced width section 79*a*, shown in FIG. 6. It also has an enlarged width section 79*b*. The reduced width section 79*a* is narrow enough so that when plate 79 is in the unlocked position, shown by the solid lines in FIG. 6, it would not obstruct the head 33. That is, the bar 11 can be lifted, allowing the head 33 to pass through the slot bottom opening 73*b*. The enlarged width section 79*b*, however, has a width that is large enough so that it will obstruct the passage of the head 33 through the bottom opening 73*b*, if plate 79 is moved to the locked position shown by the dotted lines 80 in FIG. 6.

The locking plate 79 has an exterior portion that extends through a slot 81 (FIG. 4) in the end cap 83. Locking plate 79 is slidingly retained in the housing 65 by a bolt 85 which is biased by a spring 87 and which extends through an elongated hole 89 (FIG. 6) formed in the locking plate 79. The bolt 85 extends through the bottom 65*c* of the housing 65, shown in FIG. 5. The spring 87 exerts a bias force to yieldingly retain the locking plate 79 in the locked and the unlocked position.

As shown by the arrows 71 and 93 in FIG. 1, the bar 11 is placed across the frame 17 by first inserting the slot 67 (FIG. 4) of bar 11 over the left hand retainer 13. Then when aligned, the right hand side of the bar is moved downwardly, causing the retainer 13 on the right hand side to be received within the slot 73 (FIG. 4). The head 33 (FIG. 8) will contact the plate 75 to maintain the bar 11 in the horizontal position. Then the locking plate 79 is pulled outwardly, causing the enlarged diameter section 79*b* (FIG. 6), to pass underneath the head 33, to prevent removal of the bar 11.

To remove the bar 11, the locking plate 79 is moved inwardly, causing the reduced width section 79*a* to locate under the head 33. Then the bar 11 is lifted on that side. Once clear of the retainer 13 on the right side, the bar 11 is moved axially to the left to slide the bar from the retainer 13 on the left side.

If the hinges 21 (FIG. 3) are located on the left hand side, rather than the right, as shown, the bar 11 can be reversed so that locking plate 79 is on the left hand side also. This is handled by removing the plate 75 (FIG. 8) by unscrewing screw 77. The locking plate 79 is removed by unscrewing bolt 85. Then, plate 75 is screwed to the bottom 65*c*, blocking the bottom opening 73*b*. The locking plate 79 is installed on the inside of the top 65*b* and end cap 83 is inverted. The bar 11 is then inverted, with the bottom opening 73*b* now becoming the top opening 73*a*. Slot 73 will now be positioned on the left side of bar 11 when it is located on the retainers 13.

A stop member 94 is mounted to the door facing side 65*a* of the housing 65. The stop member 95 is an elastomeric circular member mounted on a threaded shaft 97. Shaft 97 is secured by a nut 99 located inside the housing 65. A retainer 101 positions the stop member 95 at the desired position. At the desired position, when the bar 11 is in place, the stop member 95 will be in contact with the door 19. This prevents the door 19 from being opened inwardly into contact with the housing 65 of bar 11. The threaded shaft 97, nut 99, and retainer 101 allows the stop member 95 to be placed at various distances from the bar 11 to accommodate various door frame 17 sizes. The stop member 95 should be located for contact with the door 19 near the edge opposite the hinges 21.

The invention has significant advantages. The retainers 13 are small and provided an attractive appearance for use in residences. The retainers 13 can be adjusted to accommodate door trim that is not parallel with the door frame. The retainers are easily installed in either residences or in commercial buildings. In commercial buildings with metal frames, the placement tool and barrel nut provide a strong and easy means to secure the retainer to the door frame. The bar is quickly positioned in place and easily removed.

While the invention has been shown in only two of its forms, it should be apparent that those skilled in the art that it is not so limited, but is susceptible to various changes without departing from the scope of the invention.

I claim:

1. A door securing apparatus for an inward swinging door supported by hinges on a frame, comprising in combination:

a tubular rectangular bar for releasable placement across the frame to prevent opening of the door;

a pair of bar retainers, each retainer having a base surface adapted for flush engagement with an inward facing surface of the door frame, and a neck member having a central axis, each retainer having a central hole extending therethrough;

each retainer having adjusting means for varying the inclination of the base surface relative to the central axis to locate the central axis perpendicular to the plane of the frame for frames in which the inwardly facing surfaces incline relative to the plane of the frame;

fastening means extending through the hole of the retainer for fastening the retainer to the frame; and slot means adjacent each end of the bar for releasably engaging the neck member of each retainer to position the bar across the door.

2. A door securing apparatus for an inward swinging door supported by hinges on a frame, comprising in combination:

a tubular rectangular bar for releasable placement across the frame to prevent opening of the door;

a pair of bar retainers, each retainer having a base and a neck member, each retainer having central hole located on a central axis;

the base having a base surface adapted for flush engagement with an inwardly facing surface of the door frame, an an inclined surface on the opposite side that inclines with respect to the central axis of the base;

the neck member having an inclined surface that inclines with respect to its central axis, and which mates with the inclined surface of the base, the base and neck member being rotatable relative to each other to position the central axis of the neck member perpendicular to the plane of the frame for frames having inwardly facing surfaces that incline relative to the plane of the frame;

fastening means extending through the holes of the base and neck member for fastening the retainer to the door frame;

slot means adjacent each end of said bar for releasably engaging the neck member of each retainer to position the bar across the door;

a stop member on a door facing surface of the bar for engaging the door to prevent the door from being opened into contact with the bar; and means for mounting the stop member to the bar at adjustable distances from the bar.

3. The apparatus according to claim 2 wherein the central axis of the base is adapted to be perpendicular to the inward facing surface of the door frame when the central axis of the neck member is perpendicular to the plane of the frame.

4. The apparatus according to claim 2 wherein the base hole is perpendicular to the base surface.

5. The apparatus according to claim 2 wherein the neck member has a head on its inward end of larger diameter than the neck to retain the bar on the retainers.

6. A door security apparatus for an inward swinging door supported by hinges on a frame, comprising in combination:

a hollow tubular rectangular bar for releasable placement across the frame to prevent opening of the door, the bar having a door facing surface;

a pair of bar retainers, each retainer adapted to be mounted to an inwardly facing side of the door frame, each bar retainer having a neck member protruding inwardly and having a head on the inward end of the neck member;

an elongated slot in the door facing surface of the bar extending parallel with the axis of the bar and terminating at one end for slidingly receiving the neck member of one of the retainers;

a locking slot in the door facing surface of the bar at the other end extending from an opening in the lower surface of the bar upwardly, perpendicular to the axis of the bar, for slidingly receiving the neck member of the other retainer, the locking slot having a width less than the head of the retainer to prevent removal of the bar other than through the opening; and a locking plate slidingly carried in the bar on the bottom of the bar and adjacent to the opening for movement between locked and unlocked positions, the locking plate having an enlarged width section that blocks the opening in the bar when the locking plate is moved to the locked position to lock the head inside the bar, and a reduced width section that permits egress of the head in the unlocked position.

7. The apparatus according to claim 6 wherein the locking plate protrudes laterally from the end of the bar to enable the locking plate to be manually moved between the locked and unlocked positions.

8. The apparatus according to claim 6 further comprising:

a stop member mounted to the door facing surface of the bar for engaging the door to prevent the door from being opened into contact with the bar; and means for mounting the stop member to the bar at adjustable distances from the bar.

* * * * *